US006210128B1

(12) United States Patent
Rife et al.

(10) Patent No.: US 6,210,128 B1
(45) Date of Patent: Apr. 3, 2001

(54) FLUIDIC DRIVE FOR MINIATURE ACOUSTIC FLUIDIC PUMPS AND MIXERS

(75) Inventors: Jack C. Rife, Washington, DC (US); Michael I. Bell, Rockville, MD (US); James Horwitz, Fairfax; Milton N. Kabler, Alexandria, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/293,153

(22) Filed: Apr. 16, 1999

(51) Int. Cl.[7] ..... F04B 17/00
(52) U.S. Cl. ..... 417/322
(58) Field of Search ..... 412/412, 410.1, 412/321, 322; 123/498; 366/127; 346/140 R, 75

(56) References Cited

U.S. PATENT DOCUMENTS 3,840,758 * 10/1974 Zoltan ..... 310/328
3,963,380 * 6/1976 Thomas ..... 417/322
4,115,036 * 9/1978 Paterson ..... 417/322
4,296,417 * 10/1981 Markham et al. ..... 346/75
4,395,719 * 7/1983 Majewski et al. ..... 347/68
5,085,562 * 2/1992 Lintel ..... 417/413.3
5,525,041 * 6/1996 Deak ..... 417/63
5,674,742 * 10/1997 Northrup et al. ..... 435/286.1
5,736,100 * 4/1998 Miyake et al. ..... 422/64
6,003,388 * 12/1999 Oeftering ..... 73/864.01
6,010,316 * 1/2000 Haller et al. ..... 417/322
6,091,406 * 7/2000 Kambara et al. ..... 345/177

* cited by examiner

*Primary Examiner*—Teresa Walberg
*Assistant Examiner*—Daniel Robinson
(74) *Attorney, Agent, or Firm*—John J. Karasek; Charles J. Stockstill

(57) ABSTRACT

The fluidic drive for miniature acoustic-fluidic pump and mixer is comprised of an acoustic transducer attached to an exterior or interior of a fluidic circuit or reservoir. The transducer converts radio frequency electrical energy into an ultrasonic acoustic wave in a fluid that in turn generates directed fluid motion through the effect of acoustic streaming. Acoustic streaming results due to the absorption of the acoustic energy in the fluid itself. This absorption results in a radiation pressure and acoustic streaming in the direction of propagation of the acoustic propagation or what is termed "quartz wind".

24 Claims, 12 Drawing Sheets

LEGEND:
EO: ELECTROOSMOSIS
QW: QUARTZ WIND

FLUIDIC DRIVE FOR MINIATURE ACOUSTIC FLUIDIC PUMPS AND MIXERS

BACKGROUND OF THE INVENTION

1. Field of the Invention

This invention pertains generally to fluid pumps and mixers, more specifically to a miniaturized acoustic-fluidic pump or mixer.

2. Description of the Related Art

The oldest methods to generate flow in fluidic systems use external pumps of various types that are bulky and cannot be miniaturized. More recently, piezoelectrical driven membrane pumps less than 1 cm×1 cm×2 mm in size have been integrated into planar microfluidic systems. But these pumps require valves that can clog or otherwise fail. Miniature valve-less membrane pumps using fluidic rectifiers, such as the nozzle/diffuser and Telsa valve are under development, but rectifiers do not perform well in the laminar flow regime of microfluidics. They also have a pulsed flow that could be undesirable.

Elecroosmosis is a valve-less, no-moving parts pumping mechanism suitable for miniaturization and has been used for a number of microfluidic systems, often because of compatibility with electrophoretic separation. Electroosmosis depends on the proper wall materials, solution pH, and ionicity to develop a charged surface and an associated diffuse charged layer in the fluid about 10 nm thick. Application of an electric field along the capillary then drags the charged fluid layer next to the wall and the rest of the fluid with it so the velocity profile across the channel is flat, what is termed a "plug" profile. The greater drawbacks of electroosmosis are the wall material restrictions and the sensitivity of flow to fluid pH and ionicity. In addition, some large organic molecules and particulate matter such as cells can stick to the charged walls. Crosstalk can also be an issue for multichannel systems since the different channels are all electrically connected through the fluid. Finally, the velocity shear occurs in or near the diffuse charged layer and such strong shear could alter the form of large biological molecules near the wall.

The oldest methods of creating circulation or stirring in reservoirs move the fluid by the motion of objects such as vanes that in turn are driven by mechanical or magnetic means. The drawbacks for entirely mechanical systems are complications of coupling through reservoir walls with associated sealing or friction difficulties. The drawback to magnetic systems is in providing the appropriate magnetic fields without complicated external arrangements.

More recently, acoustic streaming has been used for promoting circulation in fluids. In Miyake et al., U.S. Pat. No. 5,736,100, issued Apr. 7, 1998, provides a chemical analyzer non-contact stirrer using a single acoustic transducer unfocussed or focused using a geometry with a single steady acoustic beam directed to the center or the side of the reaction vessel to generate steady stirring. That patent, however, does not specify whether the flow is laminar or turbulent. Flow is laminar for microfluidics where the Reynolds numbers are less than 2000 and the very lack of turbulence makes mixing difficult. Nor does Miyake et al. address the production of non-steady mixing flows by multiple acoustic beams nor the higher frequencies necessary for maximum circulation for microfluidic reservoirs less than 1 cm in size. In laminar flow, two fluids of different composition can pass side-by-side and will not intermix except by diffusion. This mixing can be enhanced by non-steady multi-directional flows such as observed with bubble pumps.

Miniaturization offers numerous advantages in systems for chemical analysis and synthesis, such advantages include increased reaction and cooling rates, reduced power consumption and quantities of regents, and portability. Drawbacks include greater resistance to flow, clogging at constrictions and valves, and difficulties of mixing in the laminar flow regime.

BRIEF SUMMARY OF THE INVENTION

The object of this invention is produce a pump for use in microfluidics using quartz wind techniques that have a steady, non-pulsatile flow and do not require valves that could clog.

Another objective of this invention is to produce a pump for use in microfluidics utilizing quartz wind techniques that work well in the laminar flow regime.

Another objective is to produce a pump for use in microfluidic systems using quartz wind techniques that do not depend on wall conditions, pH or ionicity of the fluid.

This and other objectives are attained by a fluidic drive for use with miniature acoustic-fluidic pumps and mixers wherein an acoustic transducer is attached to an exterior or interior of a fluidic circuit or reservoir. The transducer converts radio frequency electrical energy into an ultrasonic acoustic wave in a fluid that in turn generates directed fluid motion through the effect of acoustic streaming. Acoustic streaming results due to the absorption of the acoustic energy in the fluid itself. This absorption results in a radiation pressure in the direction of propagation of the acoustic radiation or what is termed "quartz wind".

DETAILED DESCRIPTION OF THE INVENTION

Figure 1:
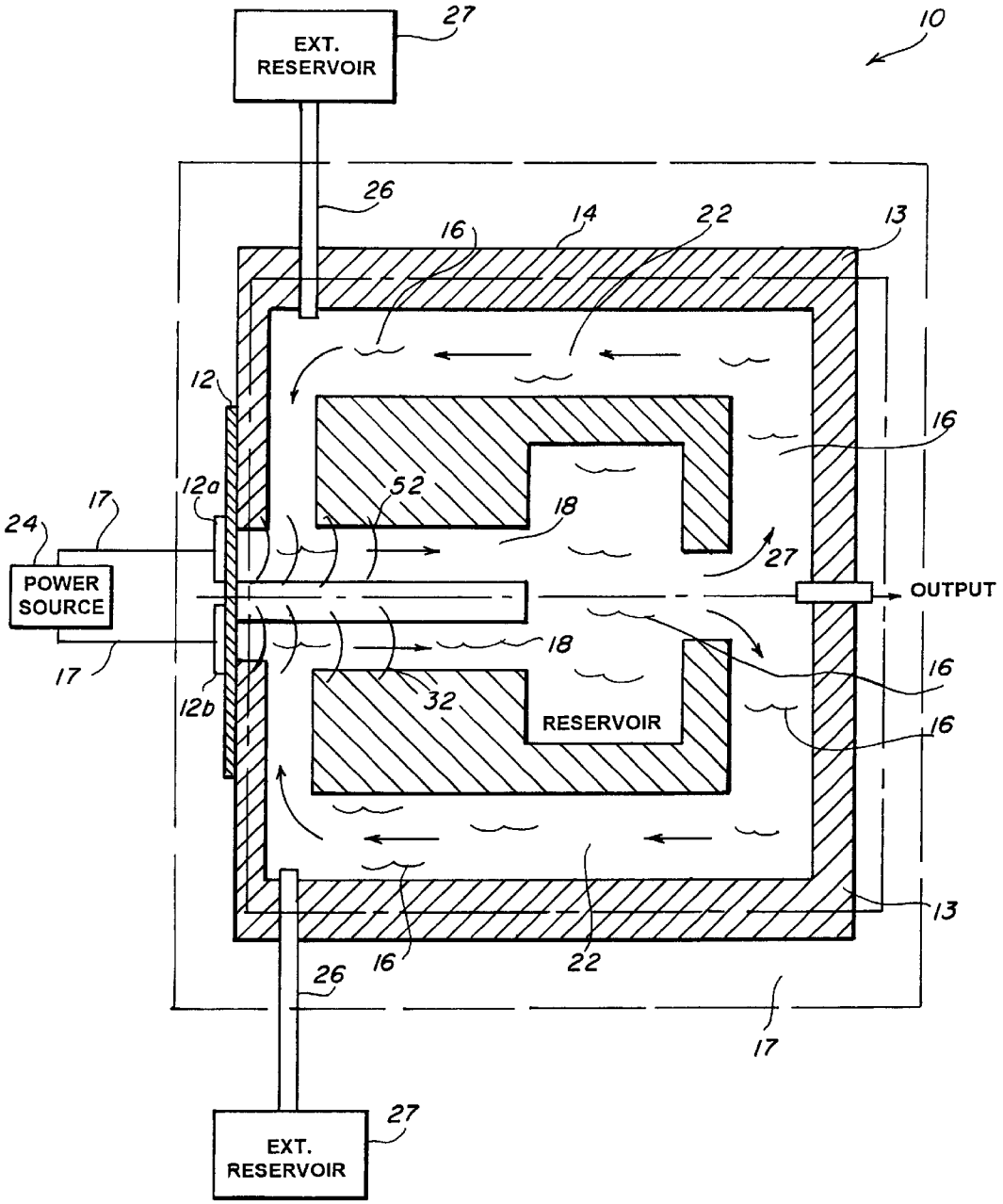
FIG. 1 shows a dual miniature acoustic-fluidic pump fluidic driver circuit in plan view.

A dual miniature acoustic-fluidic drive 10, in this embodiment a pump, as shown in FIG. 1, is comprised of an acoustic transducer array 12 attached to an exterior or interior of a fluidic circuit 14. Each transducer 12*a* and 12*b* converts radio frequency electrical energy into an ultrasonic acoustic wave in a fluid 16 that in turn generates directed fluid motion through the effect of acoustic streaming. Acoustic streaming can result from traveling waves on walls but in this invention it is due to the absorption of the acoustic energy in the fluid 16 itself. This absorption results in a radiation pressure in the direction of acoustic propagation or what is termed "quartz wind". For quartz wind, an exponentially decaying acoustic intensity generates a body force or force per unit volume on a fluid 16 in a reservoir 28 or channel 18 equal to $$F = \frac{I}{l_\mu c} e^{-\frac{x}{l_\mu}} \tag{1}$$

where I is the acoustic intensity, c is the velocity of sound in a fluid 16, and $l_\mu$ is the intensity absorption length in the fluid 16 or the inverse of the absorption coefficient. The force is in the direction of propagation on the acoustic radiation. The resultant flow velocity across a channel 18 filled across its width with an acoustic field is parabolic, with zero velocity at the walls due to the non-slip condition there. The velocity shear increases linearly with the distance from the center of the channel 18, with zero shear and maximum velocity at the center of the channel 13. The mean velocity is one half of the maximum for circular cross-sections. For a channel 18 circular cross section approximately as long as the absorption length and with no external impedance or restriction to flow, the mean velocity $u$ is given by $$u = \frac{P}{8\pi\eta c l_\mu} \tag{2}$$

where P is the acoustic power absorbed by the fluid 16 in the channel and η is the viscosity. For fully absorbed beams, P is equal to the intensity times the cross sectional area. The absorption length in fluids is typically inversely proportional to the frequency squared and is equal to 8.3 mm in water at 50 MHz. Shorter absorption and channel lengths at higher frequencies are desirable for higher velocities. Frequencies high enough to reduce the absorption length to less than the reservoir 28 or channel 18 length in microfluidic systems are also desirable to reduced the reflected intensity which would otherwise lower the velocity. In addition, higher frequencies result in less angular spread of acoustic beams due to diffraction. The other major performance measure of pumping action is the ability to pump against backpressure or the "effective pressure". For large external impedances $Z_{ex}$ and channel lengths equal to one or two absorption lengths, a pressure gradient builds up whose maximum $p_f$ is given by $$p_f = \frac{I}{c}\left(1 - e^{-\frac{x}{l_\mu}}\right) \tag{3}$$

For an external impedance much higher than the external impedance, the volumetric flow is given by $$Q \approx \frac{\left(\frac{I}{c}\right)}{Z_{ex}}, \tag{4}$$

as long as the pump 13 is one or a few attenuation lengths long. In this case, there is no advantage in increasing the frequency and shortening the pump 13 because the overall flow is determined by the intensity or the power absorbed in the channel 18 and the external fluidic impedance in the circuit. In the other limit, with low external impedance or in reservoirs 28, $$Q \approx \frac{\left(\frac{I}{c}\right)}{Z_{in}} \tag{5}$$

and higher frequencies and smaller lengths can result in useful higher velocities. This would be an advantage in stirring and mixers, for example.

Quartz wind velocity and effective pressure are limited by heating and cavitation tolerance. A small fraction, u/c, of the incident acoustic energy goes into kinetic energy of the fluid with the rest going to heat. For fluid 16 velocities of a few millimeters per second and these short pumping channel 22 and absorption lengths, a quartz wind pump 17 is self-cooled by the fluid passing through. Temperature rises would be determined then by overall system dimensions and not pumping channel 13 dimensions. Cavitation limits are determined by the amount of gas dissolved in the fluid 16 and the toleration of bubbles. For degassed fluids, cavitation thresholds are several atmospheres at $10^5$ Hz and below and increase with the square of the frequency above, and the transducers 12*a* an 12*b* may break down at lower power levels.

A first embodiment 10 comprised of a pair of pumps or channels 13 driven together or separately by two transducers 12*a* and 12*b* out of pumping channel 18. Each pump 13 consists of a pumping channel 18 and a return circuit 22 or external reservoirs 27 or an external circuit with inputs 26 and an output 27 when the return circuit 22 is blocked. The most simple pump 13 consists of a single transducer.

An array of piezoelectric thin-film transducers assembly array 12, of which only two transducers 12*a* and 12*b* are used in this instance, is attached to a simple fluidic circuit 14 is shown in plan view in FIG. 1 for pumping a fluid 16 around a return path 22 or from input port 26 and out of an output port 27. The fluidic circuit 14 is milled out of a block of polymethylmethacrylatc (PMMA), such as plexiglass acrylic sheet, manufactured by Atohaas North America, Inc. of Philadelphia, Pa., with pumping channel 18 widths of approximately 1.6 mm square and square return channels of approximately 3.2 mm. The beginning of the two pumping channels 18 are milled out of the side of the block so that the silicon wafer 42 contacted water 16 and acoustic waves 32 pass directly down the channel 18. The transducer array 12 is attached directly to the PMMA forming the fluidic circuit 14 with silicone rubber, such as RTV 110, manufactured by General Electric Co. of Waterford, N.Y., to ensure a water tight seal. The transducer array 12 is mounted on the outside of the fluidic circuit 14, or air side, so electrical connections 17 and all metallizations are in air and not in fluid 16. The acoustic energy is almost entirely reflected at the air/transducer interface due to the large mismatch of characteristic impedances there, while almost all of the acoustic energy emitted by each transducer 12*a* and 12*b* passed through a silicon substrate (not shown) and out into the fluid 16. The transducers 12*a* and 12*b* in the array are powered by an electrical power source 24. They could have been physically separate individual transducers 12*a* and 12*b* separately mounted. The size of the separate transducers 12*a* and 12*b* and their spacing in the array essentially matched the cross-section and spacing of the fluidic pumping channel 18 to fill the approximately 1.6 mm square cross-sections with the acoustic beams 32. Most of the acoustic energy was absorbed in the 10 mm length of the pumping channels 18. External to the pumping channels 18 is a common reservoir 28 at their termination and the main return channels 22, which are approximately 3.2×3.2 mm in cross-section.

With the main return channels 22 unblocked and no external circuit connected, each pumping channel 18 generates a circulation in its respective part of the fluidic circuit 14 leading to flows up to 2 mm/s at a resonance near 50 MHz. Eight resonances in pumping velocity were observed in a test installation from 20 to 80 MHz. The resonances were separated by 7 MHz and were each about 2 MHz wide. The envelope of these resonances was centered at 50 MHz and the envelope width was as expected for the characteristic impedance mismatch of the transducers 12*a* and 12*b* and the fluid 16. The eight resonances were due to multiple reflections and standing waves in the silicon wafer (not shown) and the 7 MHz separation was expected from the wavelength and velocity of sound in the silicon. With the radio frequency power 17 applied to each channel shielded from the other, crosstalk was negligible. The circulation of the fluid 16 in each channel 13 could be stopped and started independently of the circulation in the other channel. There was no apparent delay or acceleration of the fluid 16 from stop to millimeter per second velocities and back to stop.

If the return channel 22 is blocked, fluid can be introduced into the pumping channel 18 at right angles through an input port 26.

Figure 2A:
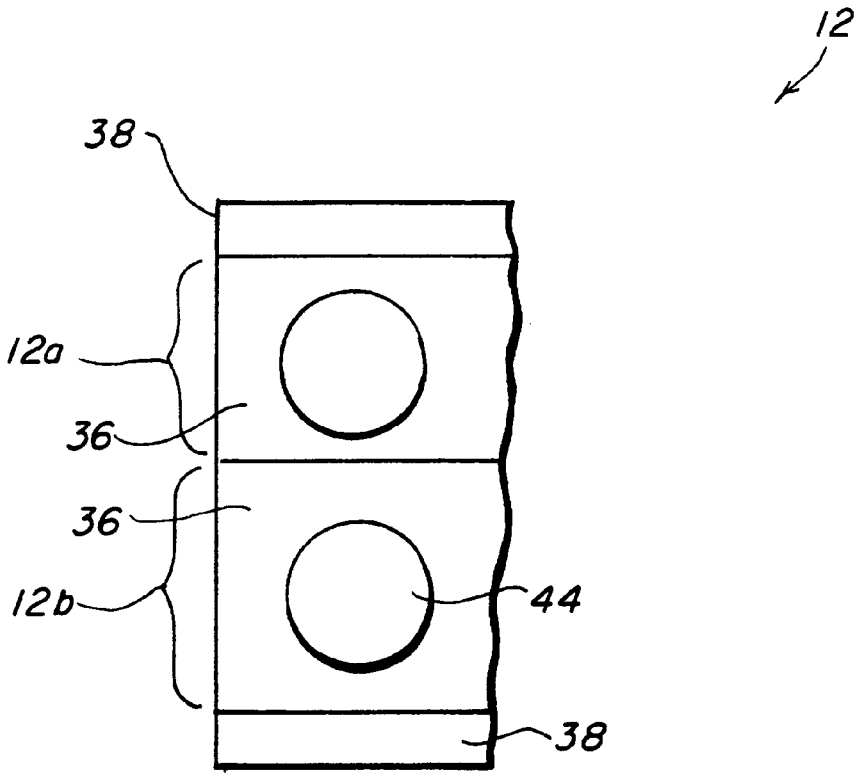
FIG. 2*a* shows a piezoelectric array of transducers in a plan view.
Figure 2B:
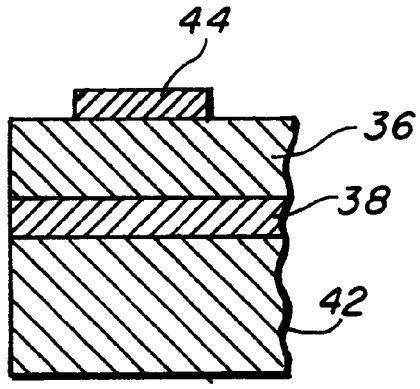
FIG. 2*b* shows a piezoelectric array of transducers in a cross-section view.

The piezoelectric array of transducers 12 is shown in a plan view in FIG. 2*a* and in cross-section in FIG. 2*b*. A typical 2×4 array of transducers 12 consists of an approximately 30–40 $\mu$m thick piezoelectric thin-film 36, preferably barium titanate ($BaTiO_3$) or lead-zirconate-titanate (PZT), a silicon wafer 42, approximately 0.020 inches thick preferably coated with platinum, with capping electrodes 44, preferably gold approximately one micron thick defining each separate transducer 12*a* and 12*b*. The capping electrodes 44 may also be silver, titanium, chromium, nickel or alloys of any of these metals. The transducers 12*a* and 12*b* are each, preferably, approximately 2.5 mm in diameter on approximately 3.5 mm centers and may be diced to provide individual transducers 12*a* and 12*b*. The $BaTiO_3$ piezoelectric thin-film 36 is, preferably, pulsed laser deposited at a temperature of approximately 700 degrees Celsius to assure proper piezoelectric phase.

Although barium titanate ($BaTiO_3$) is specified as the preferred material for the piezoelectric thin-film 36, lead-zirconate-titanate (PZT), zinc oxide (ZnO), a polymer (polyvinylidene fluoride (PVDF)), or any other material known to those skilled in the art. However, any technique known to those skilled in the art that is capable of producing such results may be utilized. The metal electrodes, 38 and 44, can also be any highly conductive metallization known to those skilled in the art. The piezoelectric thin-film 36 thickness was chosen so that the film 36 would generate a maximum of acoustical power in the fundamental thickness mode resonance near a frequency of 50 MHz. The condition for ideal resonance is that the thickness is between one-fourth and one half of the longitudinal acoustic wavelength in the piezoelectric thin-film material 36 depending on characteristic acoustic impedances at the interfaces. The dimensions shown are for a typical array, the piezo thickness 36 would be different for different frequencies. The silicon wafer 42 thickness is not crucial but would alter the frequency spread of resonances and perhaps intensity through attenuation.

This invention is not limited in type of transducer 12*a* and 12*b* or geometry of circuit or reservoir 28. To take maximum advantage of the absorbed acoustic energy, the frequency should be selected so that the absorption length is equal to or smaller than the channel 18 or reservoir 28 length. Any transducer, such as a piezoelectric, magnetostrictive, thermoacoustic or electrostatic, can be used that efficiently converts electrical energy to acoustic at the proper frequency. Piezoelectric thin film transducers, 12*a* and 12*b,* as described herein, can have any piezoelectric as the active material and any suitable substrate but the piezoelectric thickness should be between one-fourth and one half the wavelength at the selected frequency depending on acoustic matches at the interface to operate on the most efficient fundamental thickness resonance.

Figure 3:
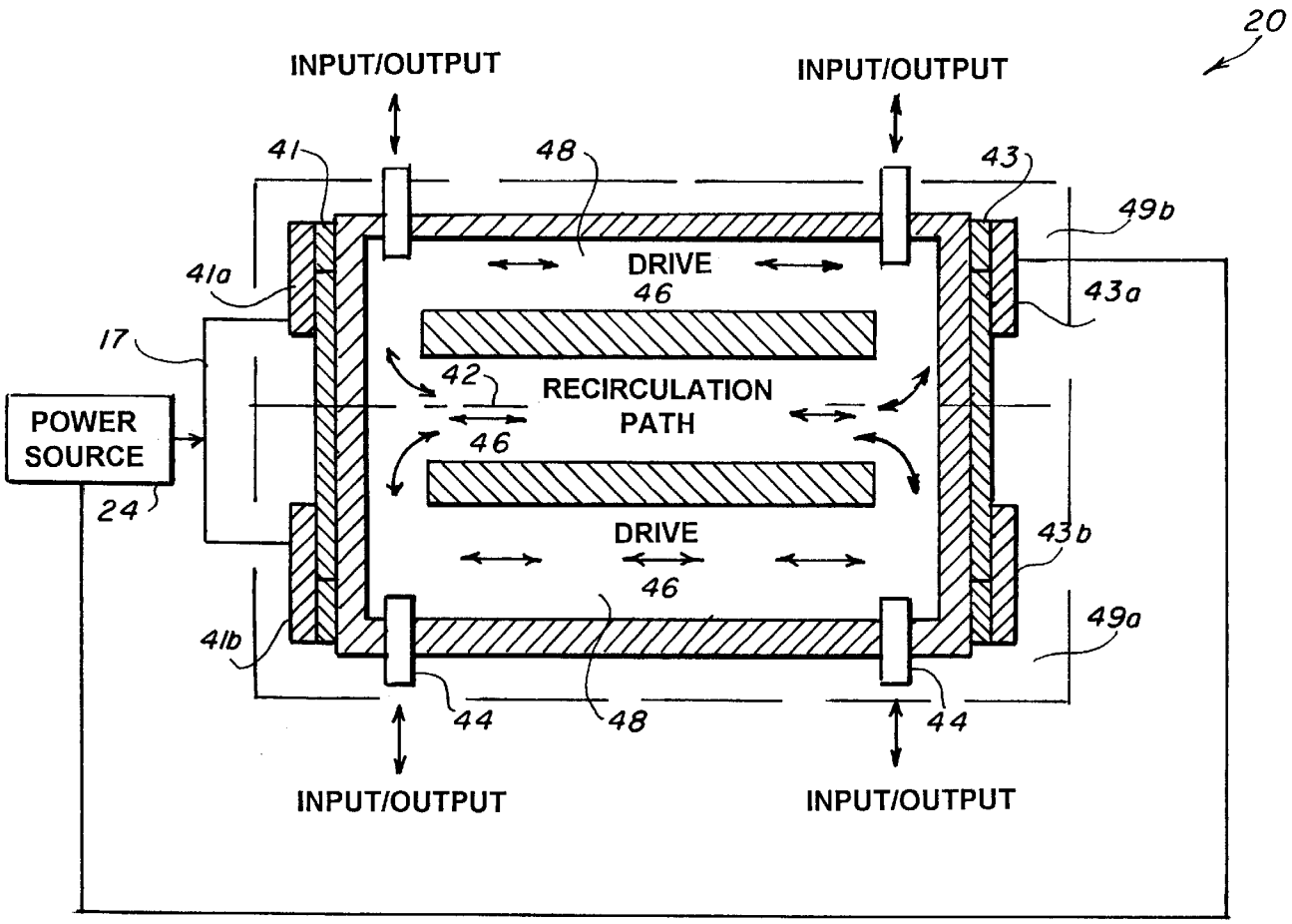
FIG. 3 shows a dual fluidic driver used as a miniature acoustic-fluidic pump capable of bi-directional control.

In a second preferred embodiment 20, as shown in FIG. 3, a dual bi-directional pump 49*a* and 49*b* having a fluidic drive constructed in the same manner as the first preferred embodiment 10, has bidirectional control. Two transducers 12*a* and 12*b* generate bidirectional flow together or separately in channels 42 and 48 by switching power from one transducer array 41 to another transducer array 43. Two individual diced transducers 41*a* and 41*b* from the array 41 are attached, as previously described, to a first end of a single pumping channel 42 approximately one cm long; at a second end of the pumping channel 42, a second array 43 of two individual diced transducers 43*a* and 43*b* are attached. The flow 46 is generated in one direction by applying a radio frequency power 24 through a circuit 17 to transducers 41*a* and 41*b* at one the first end of the pumping channel 42. When the power source 24 is terminated suddenly by switching the power OFF, and power is no longer suppied to transducers 41*a* and 41*b* flow is generated in the other direction by applying the radio frequency power 24 to the transducer array 43 activating transducers 43*a* and 43*b* at the second end of the channel 42. The bidirectional flow can be generated internally in the return channel 42 or with return channel 42 blocked in an external circuit connected with ports 44.

Figure 4:
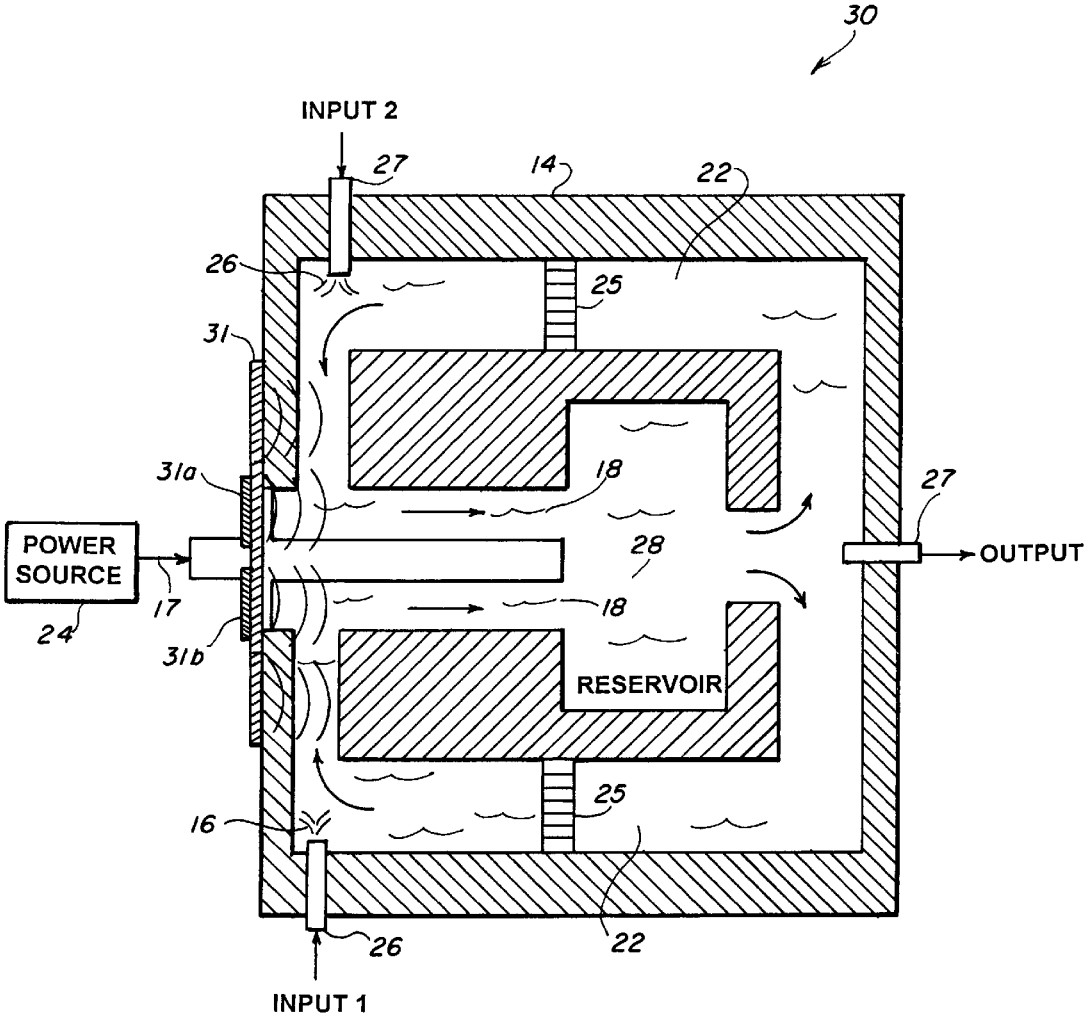
FIG. 4 shows a fluidic driver for use as a miniature acoustic-fluidic mixer in plan view.

A third preferred embodiment, as shown in FIG. 4, is a fluidic drive 30 configured as a ratioed microfluidic mixer or ratioed fluid pump 30, similar to the pumps shown in the preceding embodiments 10 and 20 shown in FIGS. 1 and 3. A first fluid is input through input port No.1 26 and a second fluid differing from the fluid 26 is input through input port No. 2 27. In this case, return flow is blocked by restrictors 25 in the return channels 22. The acoustic energy generated by the transducers 31*a* and 31*b* of a transducer array 31 causes both fluids 16 and 19 to pump proportionally to the RF power 17 applied by a power sources 24, 24*a* and 24*b* mixing the fluids 16 and 19 as they flow in the reservoir 28. The mixed fluid being extracted through output port 27.

Mixing of fluids in the low-Reynolds-number, laminar flow regime is made more difficult due to the lack of turbulence. Mixing is limited by interdiffusion rates and so becomes more rapid for smaller volumes or capillaries. Mixing can be made more rapid by the forced intermingling of fluid streams with shear, folding, and non-cyclic paths.

Figure 5B:
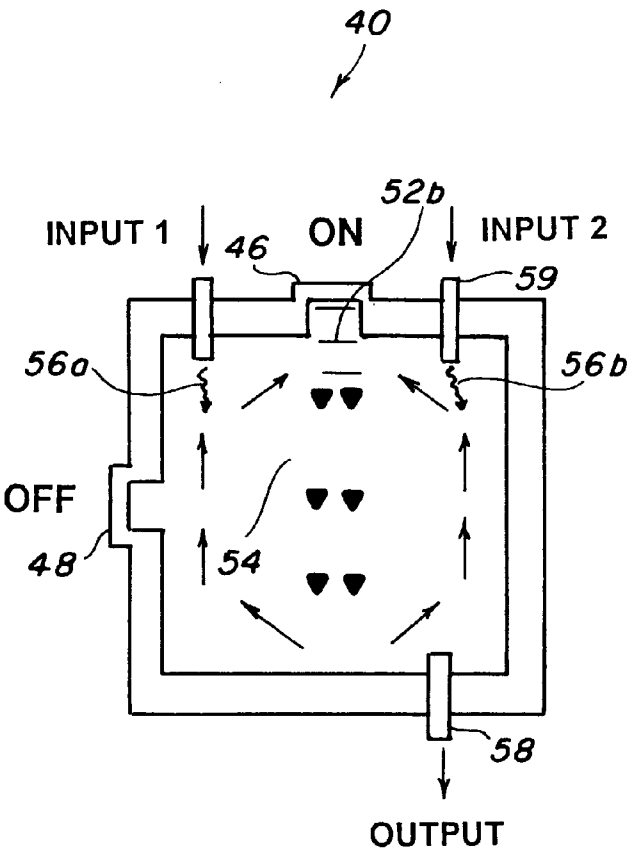
FIG. 5*b* shows a plan view of a second transducer in an ON condition of a pair of transducers mounted so their acoustic beams are directed at different angles across a rectangular reservoir and a transducer powered ON or OFF alternately to form a non-steady multi-directional flow mixer.
Figure 5A:
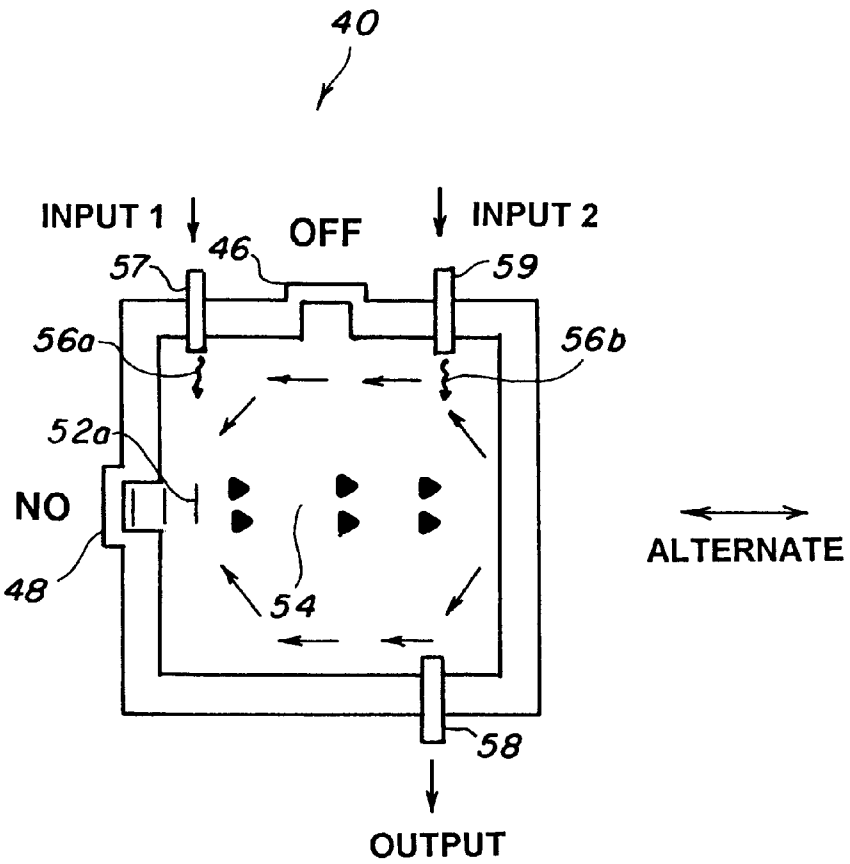
FIG. 5*a* shows a plan view of a first transducer in an ON condition of a pair of transducers mounted so their acoustic beams are directed at different angles across a rectengular reservoir and a transducer powered ON or OFF alternately to form a non-steady mixer.

Another preferred embodiment 40, as shown in FIGS. 5*a* and 5*b,* consists of two or more transducers 46 and 48 are mounted so their acoustic beams 52*a* and 52*b,* respectively, are directed in different directions across a reservoir or capillary 54 and powered alternately to form non-steady multi-directional mixes. As shown in FIGS. 5*a* and 5*b,* the acoustic beams 52*a* and 52*b* of the two transducers 46 and 48 are directed at right angles to each other across the reservoir 54, for maximum effect. As in the first embodiment 10, the operating frequency has been chosen so that the attenuation length of the acoustic radiation is less than or equal to the distance across the reservoir 54 for maximum unidirectional force per unit volume and maximum streaming velocity. Each transducers 46 and 48 width, as shown, is less than the reservoir 54 width so that the acoustic radiation underfills the cavity and a return circulation develops outside the acoustic beams 52*a* and 52*b,* as shown by the arrows. Two fluids 56*a* and 56*b* to be mixed can be introduced through input 1 57 and input 2 59 filling the right and left sides of the reservoir 54. With transducers 48 ON and transducers 46 OFF, as shown in FIG. 5*a,* steady sheared mixing occurs with repeating circulation paths. Alternating the RF power application between transducers 48*c* and 46, a more rapid mixing is achieved by breaking the cyclic circulation paths and reducing more quickly the interdiffusional distances for complete mixing. The mixed fluids 56*a* and 56*b* are output from the reservoir 54 through an output port 58.

FIGS. 5*a* and 5*b* show a square reservoir 54, but such a reservoir 54 could be circular in shape to minimize or eliminate the dead volumes at the corners and maximize mixing. The depth of the reservoir 54 can be equal to or greater than the height of the transducers 46 and 48. Rapid mixing can also be achieved for two side-by-side flowing streams in a capillary 54 in the same manner with a pair of transducers 46 and 48 placed with their normals orthogonal to each other and the flow direction down the capillary 54.

Figure 5D:
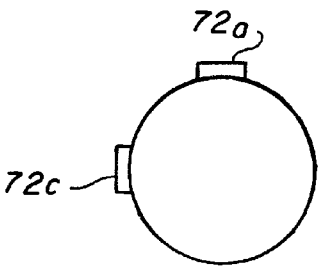
FIG. 5*d* shows a circular cross section fluidic driver wherein the transducers may be placed at intervals down the length of a tube.
Figure 5C:
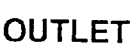
FIG. 5*c* shows a lengthwise view of a fluidic driver with transducers placed at intervals down the length of a tube.
Figure 5C:
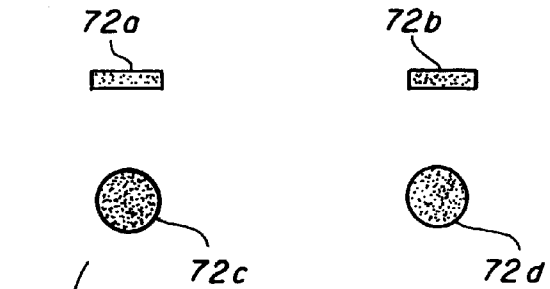

In addition, more than one pair of transducers 72*a,* 72*b* and 72*c* can be placed at intervals down the length of the capillary 54, as shown in FIG. 5*c*. The cross section of the capillary 54 does not have to be square, as shown in FIGS. 5*a* and 5*b,* but could be round, as shown in FIG. 5*d*.

Figure 5E:
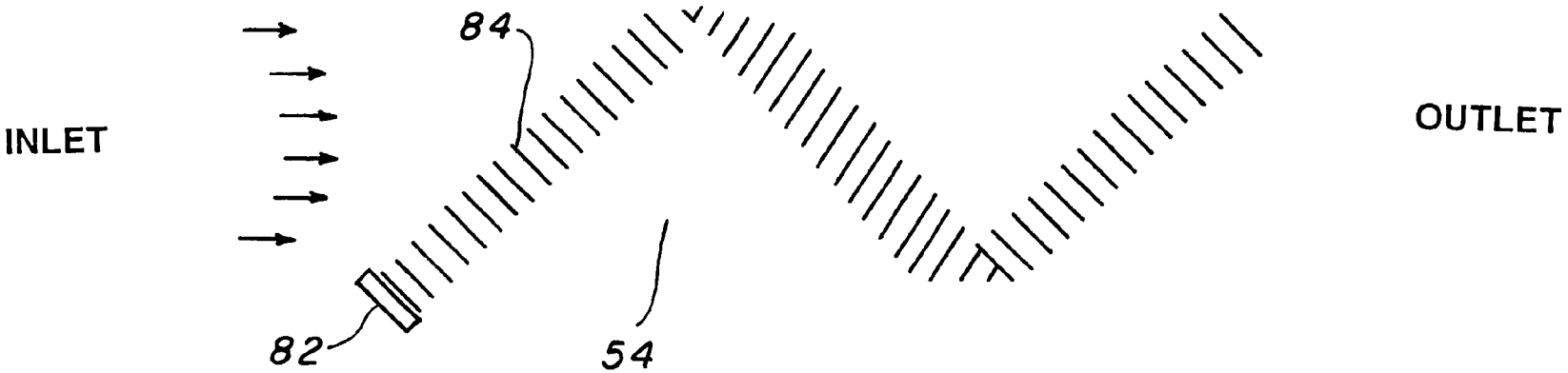
FIG. 5*e* shows a fluidic driver having a single transducer directed with its normal and acoustic beams at a grazing angle to the capillary walls in the same direction as the flow at a sufficient angle so the capillary acts as a waveguide with high or total-internal acoustic reflectivity in cross section with one of the transducers energized.

Alternatively, a single transducer 82, as shown in FIG. 5*e,* can be directed with its acoustic beam 84 at a grazing angle to the capillary 54 walls but in the same direction as the flow at a sufficient angle so the capillary 54 acts as a waveguide with high or total-internal acoustic reflectivity. The acoustic beam 84 reflected multiple times down the capillary 54 will generate mixing and also impart an additional pumping force.

As shown in FIGS. 1, 3 and 4, transducers 12*a* and 12*b;,* 41*a,* 41*b,* 43*a* and 43*b;* and 31*a* and 31*b,* respectively, can be used individually to generate unfocussed acoustic beams or with acoustic lenses to increase the intensity and the velocity of a stream or the velocities of streams in small focal regions.

Figure 6B:
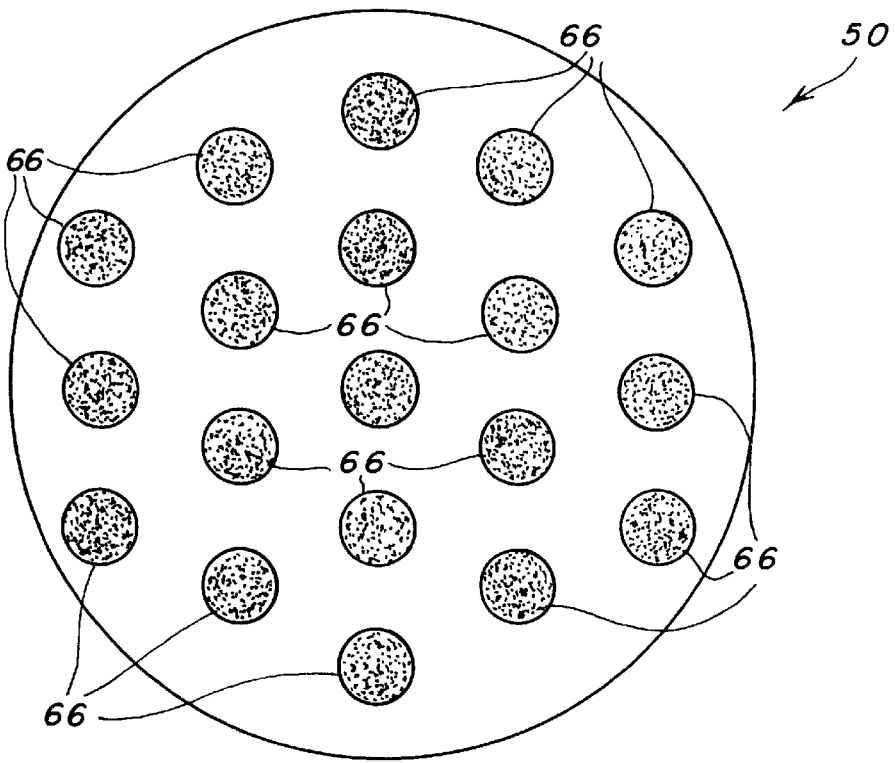
FIG. 6*b* shows a cross sectional view of a fluidic driver for use as an acoustic focusing element in cross section with a plurality of transducers mounted on a spherical surface.
Figure 6A:
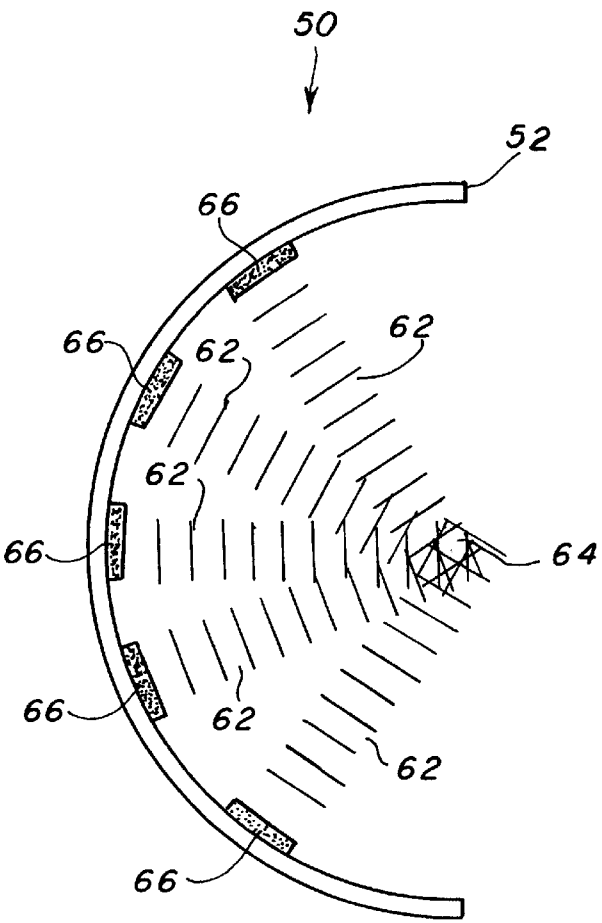
FIG. 6*a* shows a fluidic driver for use as an acoustic focusing element in plan view with a plurality of transducers mounted on a spherical surface.
Figure 6C:
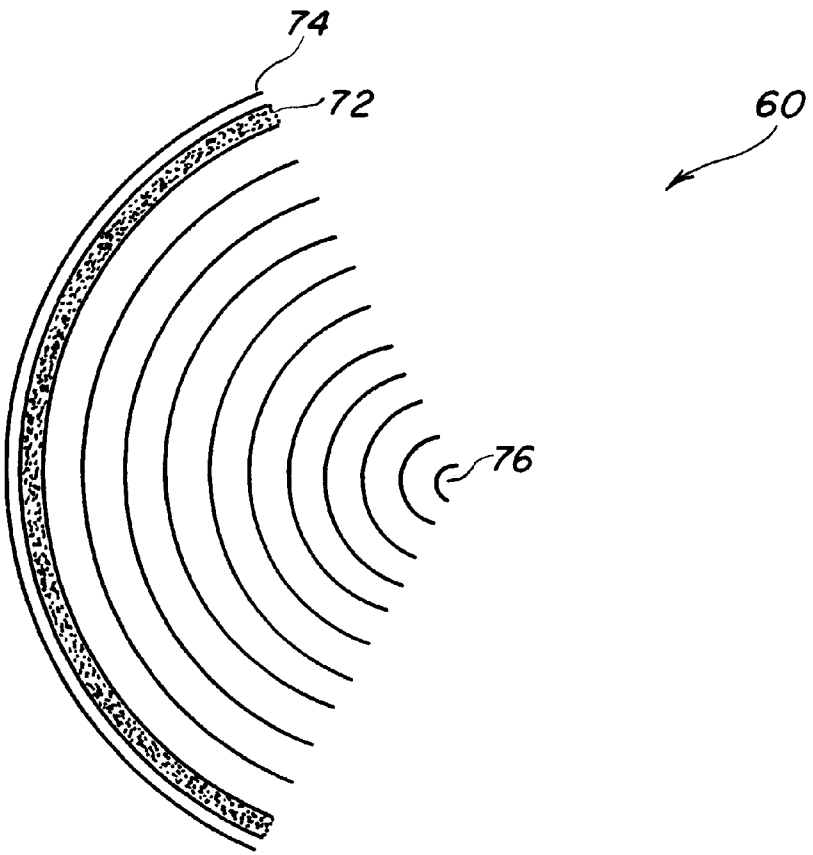
FIG. 6*c* shows a fluidic driver for use as an acoustic focusing element using a single spherical transducer.
Figure 6D:
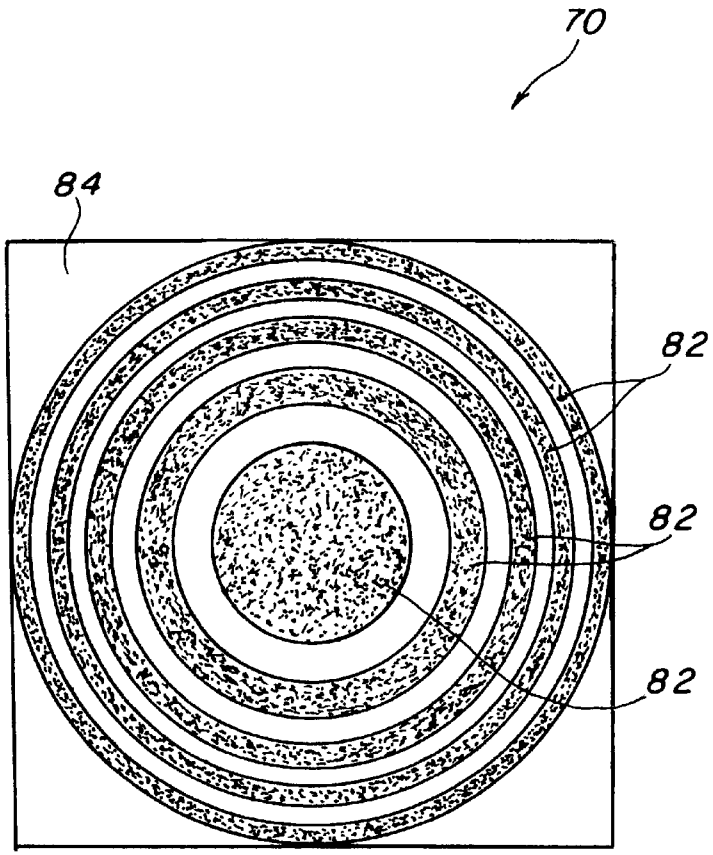
FIG. 6*d* shows a fluidic driver for use as an acoustic focusing element in plan view using a plurality of transducers energized in phase in a Fresnel zone plate pattern.
Figure 6E:
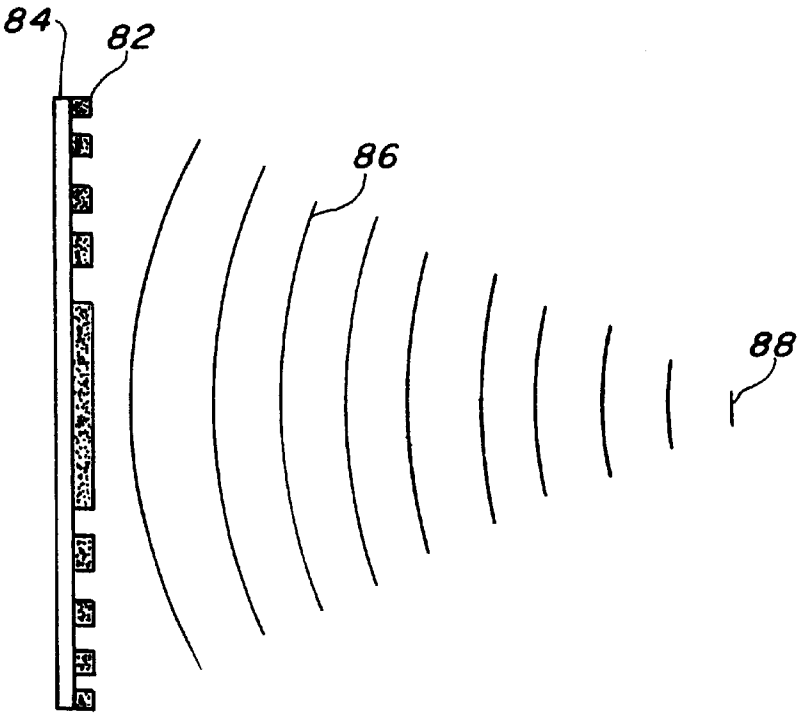
FIG. 6*e* shows a fluidic driver for use as an acoustic focusing element in cross section view using a plurality of transducers energized in phase in a Fresnel zone plate pattern.

In another embodiment 50, as shown in FIGS. 6*a* and 6*b,* acoustic energy 62 from a plurality of transducers 66 is focused or directed by phasing an array of transducers 66 on a surface 52 to a focal point 64. Focusing is achieved, for example, by identical transducers 66 mounted on a spherical surface 52 and phased together, or a fluidic circuit 60 wherein a single spherical transducer 72, as shown in FIG. 6*c,* is placed on a spherical surface 75 generating acoustic energy on a focal point 76. Also, a fluidic circuit 70 phased by a properly patterned and phased array 82 on a flat surface 84, as in the Fresnel Zone plate pattern shown in FIG. 6*d* and FIG. 6*e*. FIG. 6*e* shows the view looking into a surface on which the phased array of transducers 82 are mounted and FIG. 6*d* shows the cross section and the separate acoustic beams 62 coming to a focus 88 of greater intensity.

Figure 6F:
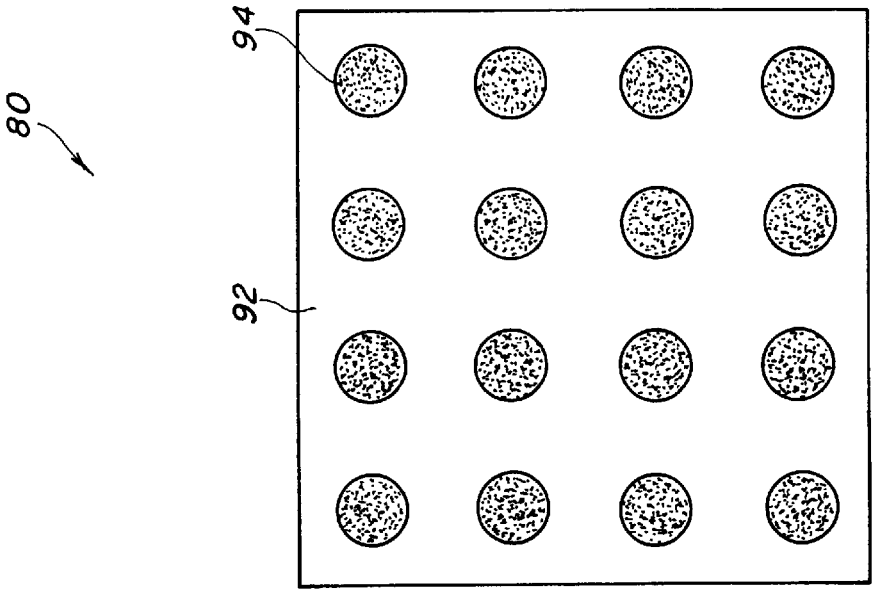
FIG. 6*f* shows a fluidic driver in plan view for use as an acoustic beam steering element using a plurality of transducers in a phased array.
Figure 6G:
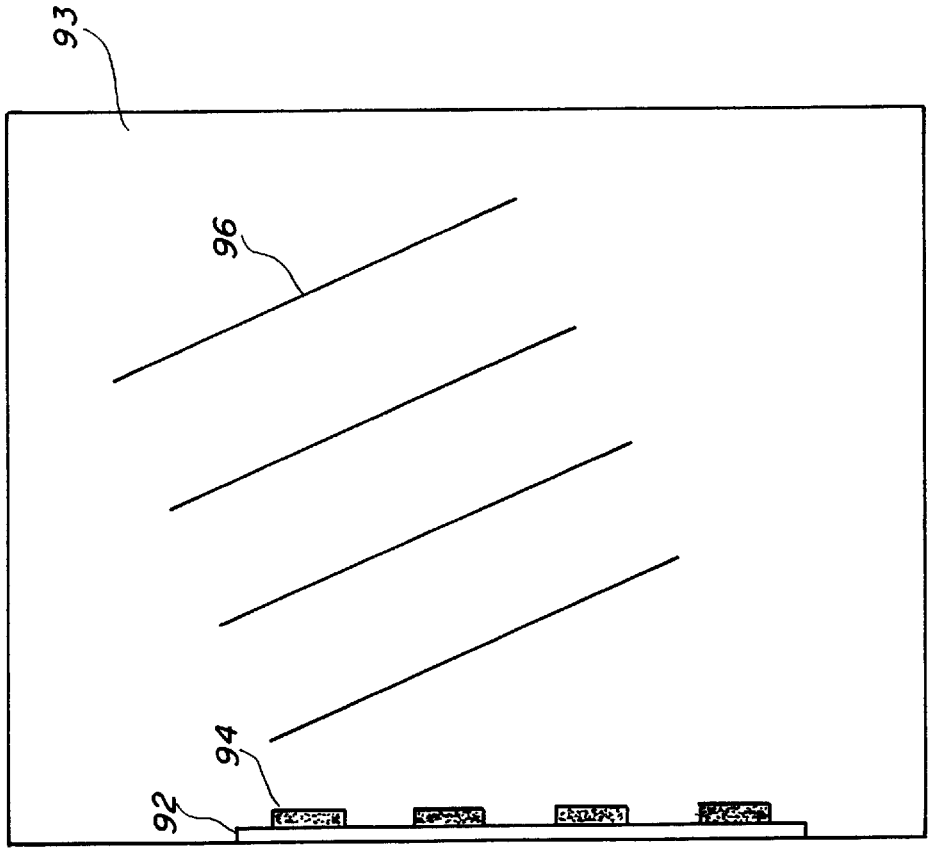
FIG. 6*g* shows a plan view of a fluidic driver for use as an acoustic beam steering element using a plurality of transducers in a phased array wherein the acoustic beam may be steered in agle with respect to the array normal to achieve mixing.

In another embodiment 80, a phased array 92 is used in a reservoir 93, as shown in FIG. 6*f* and FIG. 6*g,* to sweep the acoustic wave 96 in an angle with respect to the array normal and enhance mixing.

Other pumps suitable for miniaturization are valved membrane and bubble pumps, membrane pumps that use fluidic rectifiers for valves, and electroosmosis pumps. Compared to valved membrane and bubble pumps quartz wind pumps lack valves that could clog and have a steady, non-pulsatile flow. The quartz wind pump also works well in the laminar flow regime unlike valve-less membrane pumps that use fluidic rectifiers.

Electroosmosis is the primary valve-less, no-moving parts pumping mechanism alternative to quartz wind for microfluidic systems. The quartz wind mechanism has the advantage of not depending on wall conditions or pH or ionicity of the fluid as does electroosmosis. The quartz wind acoustic force does depend on absorption lengths and viscosity in channels but these properties would not vary much for many fluids and fluid mixtures of interest. Particles or other inhomogeneities with absorption lengths that differ to a significant degree from the fluid could result in varying local radiation pressure and velocities. That could be a disadvantage or could be taken advantage of, for example, for separation based on particle size or absorption length or for mixing.

Figure 7A:
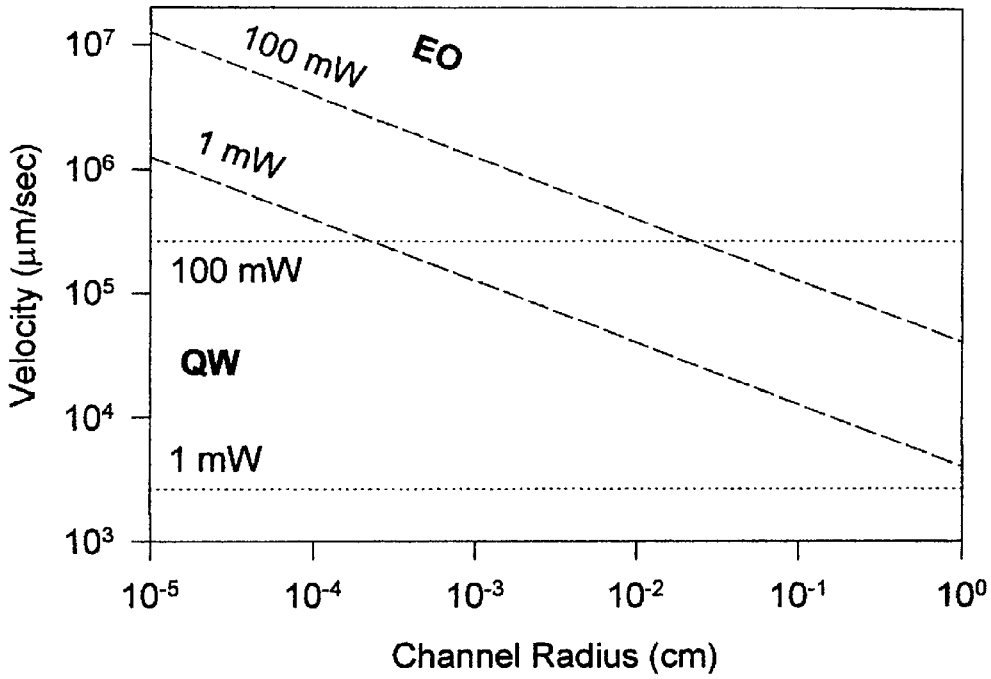
FIG. 7*a* shows a plot of calculated velocity versus channel radius for quartz wind at 50 MHz and electroosmosis at a zeta potential of 100 mV for two levels of applied power in a 1 cm long channel.
Figure 7B:
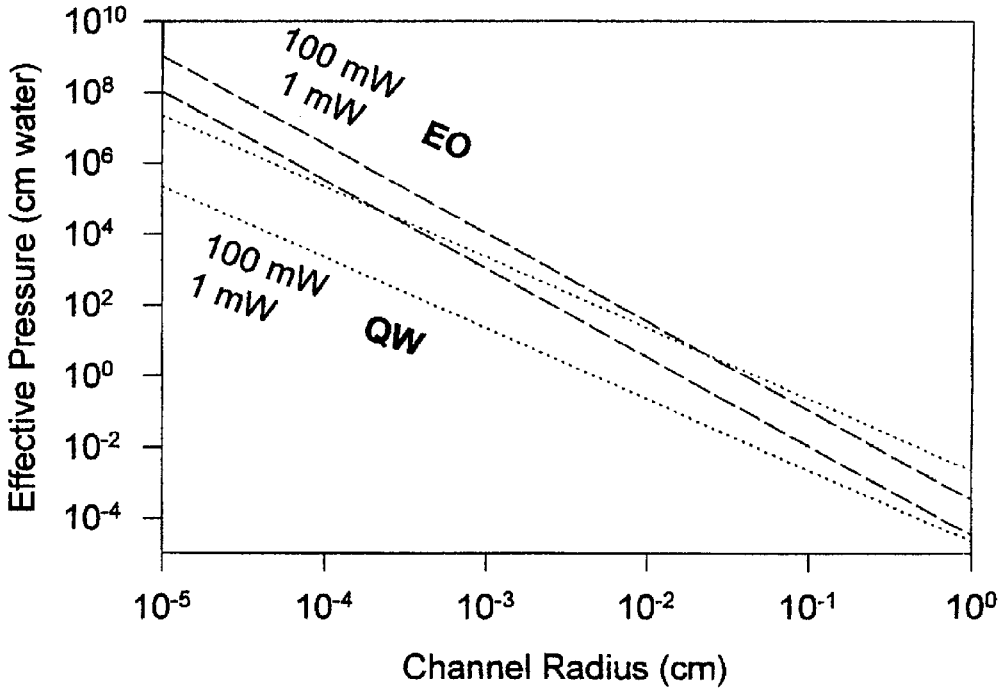
FIG. 7*b* shows a plot of effective pressure versus channel radius for quartz wind at 50 MHz and electroosmosis at a zeta potential of 100 mV for two levels of applied power in a 1 cm long channel.

Plots of the calculated velocity and effective pressure versus channel radius for quartz wind and electroosmosis and for two levels of applied power in a 1 cm long channel are shown in FIG. 7*a* and FIG. 7*b,* respectively. At powers of 100 mW, quartz wind has higher performance for channel widths above 700 microns in width whereas electroosmosis has higher performance for smaller channel sizes. This power refers to acoustic power in the pumping channel for quartz wind and electrical power or current times the voltage dissipated in the channel for electroosmosis. Losses in conversion of electrical energy to acoustical energy or in joule heating due to the resistivity of the fluid are not considered. The actual channel size above which quartz wind has higher velocity or effective pressure depends on the maximum power that can be applied for each, and that will be determined by the details of cooling geometry and cavitation. Other drawbacks to electroosmossis such as sensitivity to fluid pH or ionicity, sticking of molecules and cells to the walls, and crosstalk can outweigh its pumping advantage over a quartz wind mechanism at smaller channel sizes.

In comparison to older mechanical methods for creating circulation, stirring, or mixing quartz wind acoustic mixers have the advantage of generating a body force in selected regions and in selected directions of the fluid. In this invention, as opposed to the acoustic stirrer of Miyake et al., supra, high frequencies are used to obtain high velocities in dimensions compatible with microfluidics, and mixing can be enhanced in the microfluidic laminar flow regime by inducing non-steady, multi-directional flows with two or more transducers powered alternatively. Acoustic lenses can also be added to produce higher velocities in small regions. Finally, arrays of transducers could be phased to direct or focus beams. In addition to beam control, the transducers to generate the acoustic fields do not have to be in the fluid eliminating the problems of mechanical linkage, seals, and compatibility with the fluid.

The primary new features that the quartz wind acoustic pumps and mixers described herein offer is a directed body force in the fluid independent of the walls chemical state of the and fluid condition and patterned arrays of transducers that can be phased for beam control. The miniature microfluidic pump and mixer may be used for any fluid, including air. Transducers generating the driving acoustic field can be small and distributed at selected points around a circuit or reservoir and can exert a force on internal fluids even through the walls. At frequencies of 50 MHz and above, the absorption length for water is below one centimeter so that velocities are higher and reflections are minimized on a scale appropriate to miniature or microfluidic systems. Quartz wind can generate selectable uni- or bi-directional flow in channels in a fluidic system or circulation in a reservoir.

The quartz wind device, as described herein, may be used in ways not directly connected with fluid movement. As previously mentioned, the radiation pressures on particles may be used to separate them by size or absorption length. Or the acoustic force may be applied normal to and through a wall to dislodge particles adhering to the wall of a fluidic system. Finally, quartz wind may be used to pressurize a volume or the directed acoustic field used to locally heat a fluid. That pressure or heat may also be used, in turn, to operate actuators or valves.

Although the invention has been described in relation to an exemplary embodiment thereof, it will be understood by those skilled in the art that still other variations and modifications can be affected in the preferred embodiment without detracting from the scope and spirit of the invention as described in the claims.

What is claimed:

1. A fluidic drive for use with microfluidic circuits comprised of:

a fluidic circuit having an interior and exterior;

a fluid within the interior of the fluidic circuit; and means for generating an ultrasonic acoustic wave in the fluid causing quartz wind acoustic streaming in the direction of acoustic propagation.

2. A fluidic drive, as in claim 1, wherein the means for generating an ultrasonic acoustic wave in the fluid causing quartz wind acoustic streaming in the direction of acoustic propagation is a transducer.

3. A fluidic driver, as in claim 2, further comprising a means for applying radio frequency power to the transducer.

4. A fluidic drive, as in claim 2, wherein said transducer is a piezoelectric transducer.

5. A fluidic drive, as in claim 2, wherein said transducer is a magnetostrictive transducer.

6. A fluidic drive, as in claim 2, wherein said transducer is an electrostatic transducer.

7. A fluidic drive, as in claim 2, wherein said transducer is a thermo-acoustic transducer.

8. A fluidic drive for use as a pump with microfluidic circuits comprised of:

a fluidic circuit having an interior and an exterior;

a fluid within the interior of the fluidic circuit;

means for generating an ultrasonic acoustic wave that generates quartz wind acoustic streaming of the fluid in the direction of acoustic propagation; and an inlet and outlet port for introducing and removing fluid into the interior of the fluidic circuit.

9. A fluidic drive for us as a mixer with microfluidic circuits comprised of:

a fluidic circuit having an interior and exterior;

a reservoir having one or more inlets and outlets within the interior of the fluidic circuit;

a plurality of fluids of different composition within the reservoir and within the interior of the fluidic circuit;

one or more transducers attached to the fluidic circuit;

a radio frequency electromagnetic signal applied to said transducers; and said transducer converting electrical energy of the applied radio frequency electromagnetic signal into an ultrasonic acoustic wave causing quartz wind acoustic streaming in the direction of acoustic propagation thereby causing the directed motion of the fluid to generate forced convection mixing of fluids of different composition within the microcircuits.

10. A fluidic drive capable of bidirectional flow for use with microfluidic circuits comprised of:

a fluidic circuit having pumping channels and a first and second end and an interior and exterior;

said pumping channel having a return channel on the interior of the fluidic circuit or an inlet and outlet port near the pumping channels opposing ends connecting the pumping channel with an exterior circuit for circulation;

a fluid within the channels of the fluidic circuit;

a first and second transducer attached to the first and second ends, respectively, of the fluidic circuit;

means for applying a radio frequency electrical energy to the first transducer and converting said applied radio frequency electrical energy into an acoustic wave in the fluid that in turn generates directed fluid motion through the effect of quartz wind acoustic streaming in the direction of acoustic propagation; and means for terminating said fluid motion by removing the applied radio frequency electrical energy to the first transducer and applying the radio frequency electrical energy to the second transducer, thereby causing a flow to be generated opposite the flow generated by the first transducer.

11. A fluidic drive for use as a ratioed flow pump with microfluidic circuits comprised of:

a fluidic circuit having an interior and exterior;

a reservoir having one or more inlets and outlets within the interior of the fluidic circuit;

two or more transducers attached to the exterior of the fluidic circuit having separate pumping channels in the interior of the circuit, said transducers of sufficient size to fill the pumping channels;

said inlets introducing a different composition fluid to each of the transducers pumping channels; and means for applying individually adjustable radio frequency electrical energy to each of the transducers so as to cause an ultrasonic acoustic wave because of quartz wind acoustic streaming and directed fluid flow within each acoustic beam and pumping channel and a combined selectable ratio fluid flow at the outlet.

12. A fluidic drive for use as a non-steady multi-directional mixer with microfluidic circuits comprised of:

a fluidic circuit having an interior and exterior;

a reservoir having one or more inlets and outlets within the interior of the fluidic circuit;

a plurality of fluids of different composition within reservoir in the interior of the fluidic circuit;

one or more transducers attached at an angle to the fluidic circuit;

said transducers of sufficient size as to underfill the reservoir cross sectional area with acoustic beams; and means for applying radio frequency electrical energy to the transducers so as to cause an ultrasonic acoustic wave because of quartz wind acoustic streaming in the direction of acoustic propagation and a forced convection as a result of directed fluid flow within an acoustic beam and a return circulation outside the acoustic beam.

13. A fluidic drive for use as a non-steady, multi-directional, flowing mixer with microfluidic circuits comprised of:

a capillary having a predetermined cross section, length, and interior, and an exterior;

a fluid flowing within the interior of the capillary;

transducers attached to the interior or exterior of the capillary at right angles to the fluid flow; and means for alternately applying radio frequency electrical energy to the transduces so as to cause an ultrasonic acoustic wave and quartz wind acoustic streaming in the direction of acoustic propagation and unsteady forced convection as a result of directed flow within an acoustic beam and a return circulation outside of the acoustic beam.

14. A fluidic drive, as in claim 13, wherein the transducers are placed at intervals down the length of the capillary.

15. A fluidic drive for use as a waveguide mixer with microfluidic circuits comprising:

a capillary of a predetermined cross section, length, an interior, and an exterior;

a fluid flowing within the interior of said capillary;

one or more transducers attached to said capillary;

means for applying radio frequency power to the transducers so as to cause an ultrasonic acoustic wave and acoustic streaming in the direction of acoustic propagation; and said transducers attached to the capillary at an angle such that the acoustic beam emitted is totally internally reflected down the length of the capillary resulting in mixing due to directed flows within the beam and a return flow outside of the beam and an additional drive flow on the fluid itself.

16. A fluidic drive for use with a fluidic circuit capable of acoustic focusing comprised of:

a fluidic circuit having an interior and exterior;

a fluid within the interior of the fluidic circuit;

means for generating an ultrasonic wave in the fluid causing quartz wind acoustic streaming in the direction of acoustic propagation; and means for steering the acoustic wave in a particular direction within the fluidic circuit.

17. A fluidic drive, as in claim 16, wherein the means for generating an ultrasonic acoustic wave in the fluid causing acoustic streaming in the direction of acoustic propagation is a transducer.

18. A fluidic drive, as in claim 16 wherein the means for steering the acoustic wave in a particular direction within the fluidic circuit is a fluidic circuit further comprised of:

said fluidic circuit having an end;

said end being formed into an spherical surface having a predetermined radius;

a plurality transducers phased together and affixed to said end, said radius causing the acoustic wave to be focused onto one or more predetermined points within the fluidic circuit.

19. A fluidic drive, as in claim 16 wherein the means for steering the acoustic wave in a particular direction within the fluidic circuit is a fluidic circuit further comprised of:

said fluidic circuit having an end;

said end being formed into a cylindrical surface having a predetermined radius;

a plurality transducers phased together and affixed to said end, said radius causing the acoustic wave to be focused onto one or more predetermined points within the fluidic circuit.

20. A fluidic drive, as in claim 16 wherein the means for steering the acoustic wave in a particular direction within the fluidic circuit is a fluidic circuit further comprised of:

said fluidic circuit having an end;

said end being a spherical surface of a predetermined radius;

a transducer having a spherical shape of the same predetermined radius as the end affixed to said first end, said radius causing the acoustic wave to be focused onto a predetermined number of points within the fluidic circuit.

21. A fluidic drive, as in claim 16 wherein the means for steering the acoustic wave in a particular direction within the fluidic circuit is a fluidic circuit further comprised of:

said fluidic circuit having an end;

said end being a cylindrical surface of a predetermined radius;

a transducer having a cylindrical shape of the same predetermined radius as the end affixed to said first end, said radius causing the acoustic wave to be focused onto a predetermined number of points within the fluidic circuit.

22. A fluidic drive, as in claim 16 wherein the means for steering the acoustic wave in a particular direction within the fluidic circuit is a fluidic circuit further comprised of:

said fluidic circuit having an end;

said end being a spherical surface of a predetermined radius;

a transducer having a spherical shape of the same predetermined radius as the end affixed to said first end, said radius causing the acoustic wave to be focused onto a predetermined number of points within the fluidic circuit.

23. A fluidic drive for use with a fluidic circuit capable of acoustic focusing comprised of:

a fluidic circuit having an interior, exterior and a end;

said end having a flat surface, and further comprising a predetermined Freznel pattern;

a fluid within the interior of the fluidic circuit;

means for generating an ultrasonic acoustic wave in the fluid causing a quartz wind acoustic streaming in the direction of acoustic propagation; and a plurality of transducers in a predetermined Freznel pattern, phased together, and affixed to said end, said phased array generating an ultrasonic acoustic wave in the fluid causing quartz wind acoustic streaming in the direction of acoustic propagation causing the acoustic wave to be focused onto a predetermined point within the fluidic circuit determined by the pattern and phasing of the transducers in the phased array.

24. A fluidic drive, as in claim 16, wherein the means for steering the acoustic wave in a particular point direction within the fluidic circuit is a fluidic circuit further comprised of:

said fluidic circuit having an end;

said end having a flat surface comprised of a phased array having a predetermined pattern; and further comprising:

said phased arrray causing the acoustic wave to be steered in a predetermined direction within the fluidic circuit determined by the pattern and phasing of the transducers in the phased array.

* * * * *